US005649638A

United States Patent [19]

Roy et al.

[11] Patent Number: 5,649,638

[45] Date of Patent: Jul. 22, 1997

[54] DEVICE ENABLING TWO CONTAINERS TO BE JOINED WITH EACH OTHER AND CONTAINER HAVING SUCH A DEVICE

[75] Inventors: Richard Roy, Bourges; Marie-Christine Paris, Fussy, both of France

[73] Assignee: Giat Industries, Versailles, France

[21] Appl. No.: 445,291

[22] Filed: May 19, 1995

[30] Foreign Application Priority Data

May 25, 1994 [FR] France ..... 94 06305

[51] Int. Cl.[6] ..... F16L 21/00

[52] U.S. Cl. ..... 220/4.26; 220/4.27; 220/23.4; 206/509; 102/282

[58] Field of Search ..... 206/509; 220/23.2, 220/23.4, 4.26, 4.27; 102/282

[56] References Cited

U.S. PATENT DOCUMENTS

| | | | |
|---|---|---|---|
| 2,415,422 | 2/1947 | Fogg . | |
| 2,857,844 | 10/1958 | Lagemann . | |
| 2,865,290 | 12/1958 | Bonsper . | |
| 3,208,620 | 9/1965 | Hedering | 220/4.26 X |
| 3,376,816 | 4/1968 | Foster et al. | 220/4.27 X |
| 3,384,259 | 5/1968 | Hoffstadt | 220/4.27 X |
| 3,485,408 | 12/1969 | Benesch | 220/4.26 |

FOREIGN PATENT DOCUMENTS

| | | |
|---|---|---|
| 1291315 | 10/1962 | France . |
| 2098668 | 10/1972 | France . |
| 2620214 | 3/1989 | France . |
| 2672672 | 8/1992 | France . |
| 2 711 209 | 10/1993 | France . |
| 2705235 | 8/1978 | Germany . |
| 917193 | 1/1963 | United Kingdom . |

*Primary Examiner*—Steven M. Pollard
*Attorney, Agent, or Firm*—Oliff & Berridge

[57] ABSTRACT

A device for joining a first face of a first container to a second face of a second container, in which the first face and the second face are alignable along a longitudinal axis, includes a plurality of hooks and a hook receiving portion. The plurality of hooks are spaced around a periphery of the first face of the first container. The hooks have tips and are movable in a direction parallel to the longitudinal axis. The hook receiving portion is disposed around a periphery of the second face of the second container. The hook receiving portion includes a groove shaped to receive the tips of the hooks so that the first container can be joined to the second container. As a result, the device permits two containers to be joined securely yet disassembled quickly.

23 Claims, 7 Drawing Sheets

DEVICE ENABLING TWO CONTAINERS TO BE JOINED WITH EACH OTHER AND CONTAINER HAVING SUCH A DEVICE

BACKGROUND OF THE INVENTION

1. Field of the Invention

The present invention relates to containers for a propelling charge, and more particularly, to containers used in large caliber or tank artillery.

2. Background of Related Art

So as to adjust the firing range, it is often necessary to modify the amount of powder which is used to launch a projectile.

Approximately cylindrical modular containers made of a combustible material are known. Because these containers are rigid, they are easier to use than the traditional bags of powder.

So as to reduce the amount of space taken up by munitions inside armored vehicles, it may also be necessary to divide the munitions into two separate parts, one part carrying the main propelling charge and the other carrying the projectile and possibly a secondary propelling charge (as disclosed, for example, in British Patent GB2136929).

Joining two or more containers together speeds loading by allowing all the containers to be inserted in a single operation, for example, by an automatic loading device.

It is critical in this event to ensure that the containers are joined in such a way as to provide a rigid assembly.

Moreover, it may prove necessary to rapidly withdraw the charge already introduced in the chamber of a weapon. A withdrawal operation consumes more time and is more difficult if the whole charge is divided into several separate loads.

French Patent FR2672672 discloses a linking device for containers that includes a sliding ring and a self-gripping fastening device arranged on a first end face of the container.

Such a device, however, is both complicated and costly to manufacture.

Moreover, it may or may not be necessary, according to operational needs, to join the containers. However, the device disclosed in French Patent FR2672672 does not permit such a choice because the axial link cannot disassembled quickly.

In addition, the disclosed device is difficult to implement. To use the ring, the two containers must be correctly positioned radially. However, the fastening device is operational irrespective of the relative radial position of the two containers. As a consequence, the two containers are difficult to align, and it is therefore difficult to join them.

French Patent FR2098668 discloses joining two explosive metallic charges by a tubular connecting sleeve having flexible tabs Which, when the charges are put into place inside the sleeve, penetrate into an annular groove made on each charge, thus joining the two charges. Such a device has the disadvantage of requiring a third element, i.e., the sleeve, which adds bulk and causes storage and implementation problems.

German Patent DE2705235 discloses a link that is not between two parts of a charge but is between a case and a munition base. The link is achieved by clipping the base onto the case, the case having a shape that matches a corresponding shape on the base. This linking device has the disadvantage of not being dismountable.

SUMMARY OF THE INVENTION

An aim of the present invention is to provide a linking device for containers that overcomes the disadvantages of the prior art.

The linking device enables a rigid and reliable link to be established between at least two containers that can be disassembled easily and does not require any extra parts. According to operational needs, the device may also be stored for an operation in which containers are not joined.

Another aim of the present invention is providing a container that may be joined with another container by linking one of its end faces with such a linking device.

The invention may be applied to modular charges as well as charges having at least two loads, one carrying the main charge and its primer tube and the other the projectile (and possibly, but not necessarily, a secondary charge).

The device for joining a first face of a first container to a second face of a second container includes a plurality of hooks, which may be moved axially and which are evenly distributed around a periphery of the first face. Each hook includes a tip designed to be received by a circular groove arranged on the second container. Each tip has a profile that corresponds to a profile of the circular groove to ensure the axial locking of the containers.

The profile of the circular groove may include at least one slanted surface that extends away from the first face of the first container.

The slanted surface of the matching profiles forms angle of less than 90° and preferably about 80° with a longitudinal axis of the container.

Each hook may be disposed to move axially within a housing arranged on the outer surface of the first container.

The hook has a peg that is able to move axially inside a slot through the outer surface of the first container that terminates at a collar of a lid that is formed as a single piece with the first face.

The hook has a heel that engages a collar when the peg abuts the lid, the peg and the heel ensuring the axial locking of the hook.

According to a second embodiment, the hooks are formed as a single piece with a tapped ring mounted onto a threaded cylindrical part of a lid of the first container.

The hooks are formed of a plastic material, preferably polyoxymethylene, high density polyethylene or polyamide.

Another aim of the present invention is providing a container designed to be joined with another container by at least one of its end faces having at least one circular groove with a profile that is designed to cooperate with a matching profile of a hook of the other container.

The container includes a base and an outer surface having a groove.

A further aim of the invention is providing a container having at least three housings arranged on its outer surface, each housing being designed to receive a hook.

The housing can be formed as a single piece with the outer surface of the container and the lid.

The lid can include a collar through which the housings extend.

According to an alternative embodiment, the container includes a lid that is formed as a single piece with the outer surface and has a threaded cylindrical part designed to cooperate with a threaded ring to which the hooks are attached.

BRIEF DESCRIPTION OF THE DRAWINGS

The invention will be made clearer after reading the description of the different embodiments, the description being made in reference to the appended drawings wherein.

DETAILED DESCRIPTION OF PREFERRED EMBODIMENTS

Figure 1:
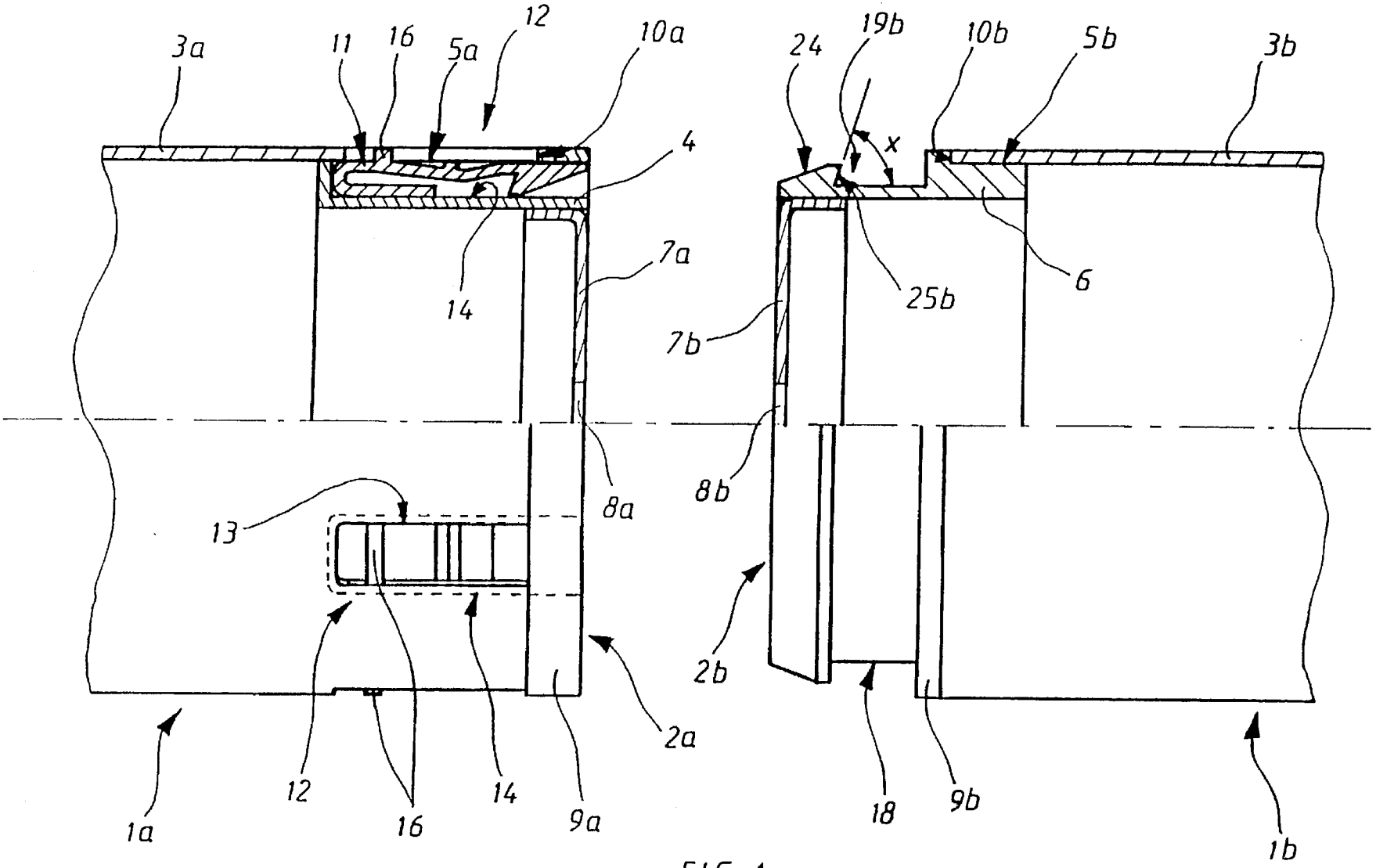
FIG. 1 shows a partial section of two containers before assembly according to a first embodiment of the invention.

With reference to FIG. 1, a first face 2*a* of a first container 1*a* is designed to be joined to a second face 2*b* of a second container 1*b*.

A partial sectional view each of the two containers is shown in FIG. 1.

Each container includes a cylindrical outer surface 3*a*, 3*b* made of a combustible material such as nitrocellulose, cardboard or a mixture of cardboard and nitrocellulose.

The containers 1*a* and 1*b* are shown partially in FIG. 1. They are designed to receive a propelling charge of grains or sticks (not shown).

The container 1*b* includes a projectile attached to its first face (not shown) by a linking ring (for example, similar to the linking ring described in French Patent FR2620214).

The container 1*a* includes a base attached to its second face (not shown) having a primer tube (see, for example, French Patent FR2672672 which shows a device for fastening such a base to the outer surface).

The container 1*a* includes a lid 4 attached to its first face 2*a* that is made of a plastic material. The plastic material can be high density polyethylene, polyamide or the like. The lid 4 can be attached to the outer surface 3*a* adjacent a cylindrical support 5*a*, e.g., by bonding.

The lid 4 includes a collar 9*a* against which one end 10*a* of the outer surface 3*a* is abutted.

The container 1*b* includes a base 6 attached to its second face 2*b* that is made of plastic material similar to the material of which the lid is made. The base 6 is attached to the outer surface 3*b* adjacent a cylindrical support 5*b*, e.g., by bonding. One end 10*b* of the outer surface is abutted against a collar 9*b* of the base 6.

End plugs 7*a*, 7*b*, which are also made of a combustible material, are inserted in the lid 4 and the base 6, respectively, to close off the ends of the container. The end plugs 7*a*, 7*b* are attached to the lid 4 and the base 6, for example, by bonding. The end plugs 7*a*, 7*b* have axial openings 8*a* and 8*b* designed so that a flame can pass from one container to another during firing of the propelling charge. These openings are obstructed in a known way by combustible foils (not shown).

The container 1*a* includes hooks 11 made of plastic material. The plastic material can be polyoxymethylene, high density polyethylene or polyamide. The hooks, of which there are six in this example, are evenly distributed around the outer surface and are designed to join the two containers together. The hooks 11 are inserted into housings 12 that enable the hooks 11 to move in an axial direction parallel to a longitudinal axis of the container.

Each housing 12 disposed adjacent the outer surface of the container includes a slot 13 through the outer surface 3*a* that terminates at the end 10*a*, as well as a longitudinal groove 14 formed in the lid 4.

Figure 2B:
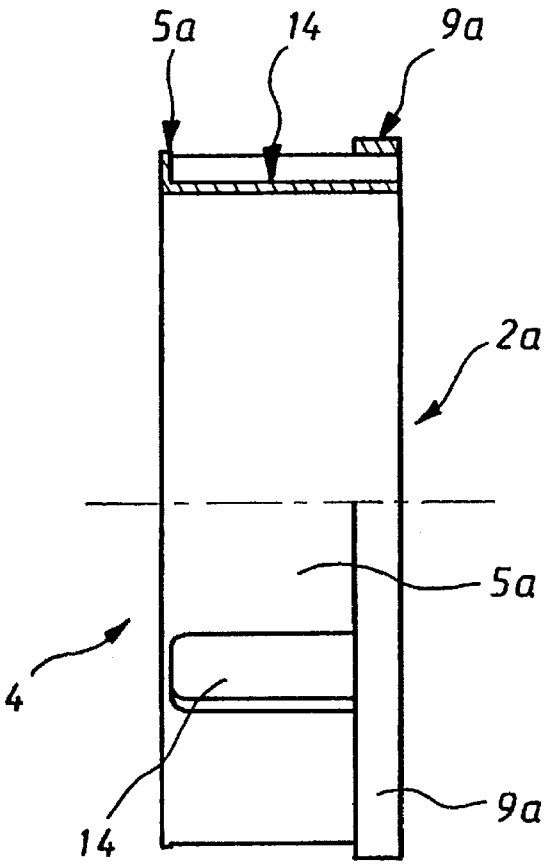
FIG. 2*a* and FIG. 2*b* show two views of an embodiment of the lid according to the invention.
Figure 2A:
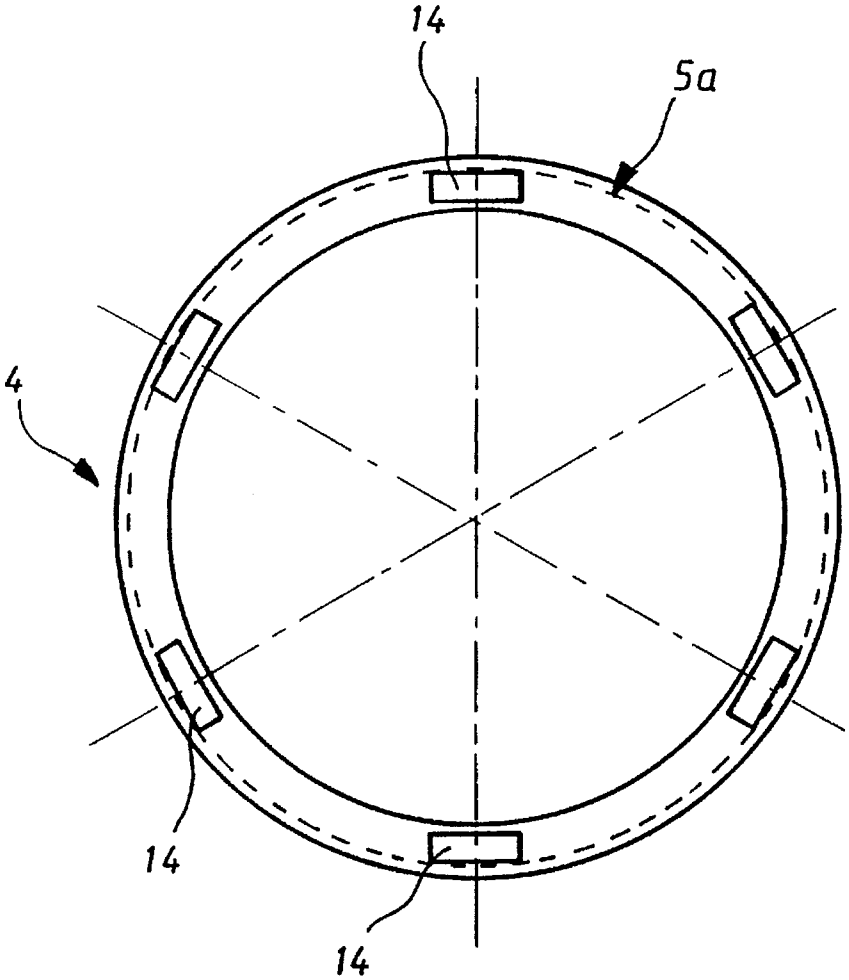

FIGS. 2*a* and 2*b* show an embodiment of the lid 4. FIG. 2*a* is a plan view of the lid 4, and FIG. 2*b* is a side view that includes a partial section of the lid 4.

The lid 4 includes six longitudinal grooves 14 evenly spaced around the circumference adjacent the cylindrical support 5*a*. The grooves 14 extend through the collar 9*a* to the front face 2*a*. Such a lid can be formed by molding.

Figure 3A:
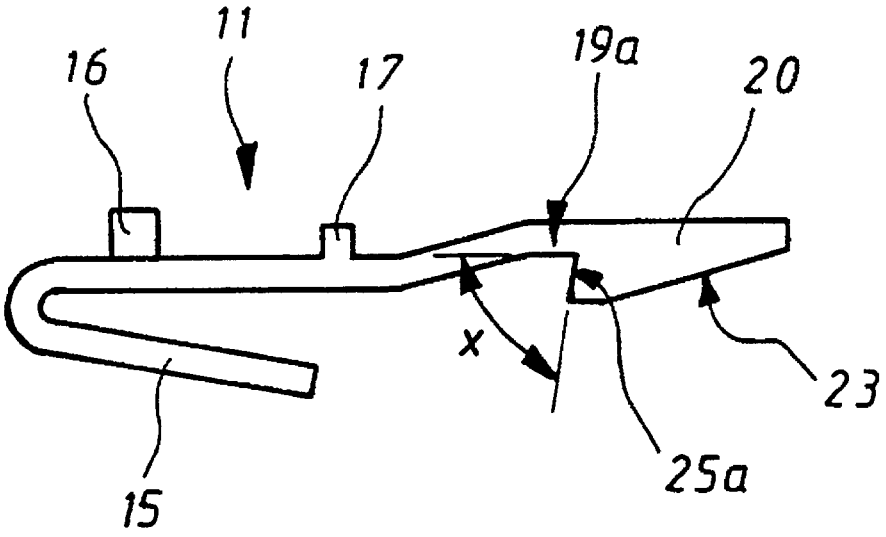
FIG. 3*a* and FIG. 3*b* show two views of an embodiment of a hook according to the invention.
Figure 3B:
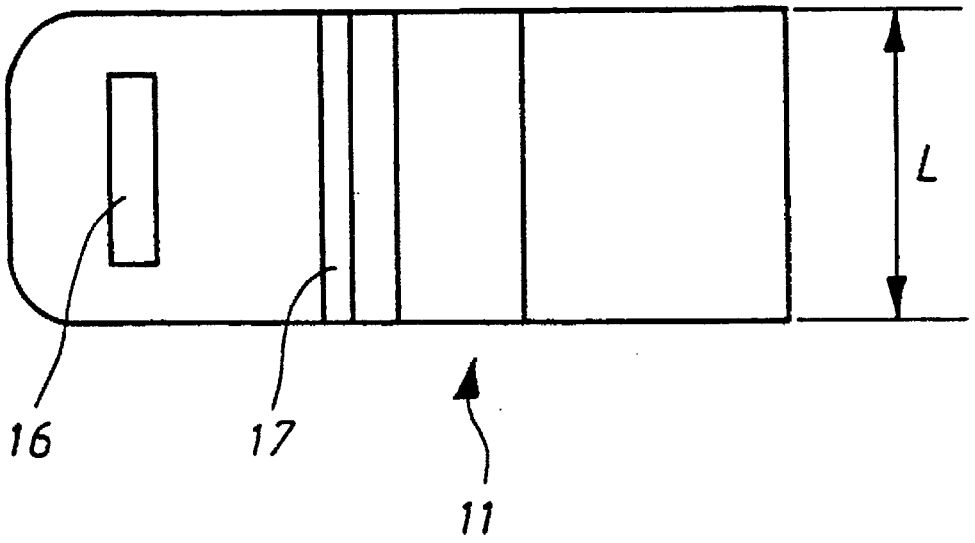

FIGS. 3*a* and 3*b* show side and top views, respectively, of an embodiment of a hook 11.

The hook 11 has a width L slightly less than the width of the longitudinal groove 14 of the lid 4 and includes a peg 16 of a width that is slightly less than that of the slot 13 of the outer surface to guide the axial movement of the hook 11 in the housing 12.

The hook 11 also includes a flexible fold 15 designed to urge the hook 11 so that it remains in contact with the inner part of the outer surface and the bottom of the longitudinal groove 14.

The hook 11 also includes a heel 17 that is designed to provide an axial stop when the containers are joined.

The other end of the hook 11 includes a tip 20 designed to be inserted into a circular groove 18 on the base 6 of the second container 1*b*. The tip has a length which is slightly less than the length of the circular groove 18.

The tip 20 has a profile 19*a* designed to cooperate with a second matching profile 19*b* of the circular groove 18. These two profiles include corresponding surfaces 25*a*, 25*b* in which the angles x are approximately equal and are less than 90°, preferably about 80°.

The profile 19*b* is such that the top of the slanted surface 25*b* extends away from the first face 2*a* of the container 1*a*.

Figure 4:
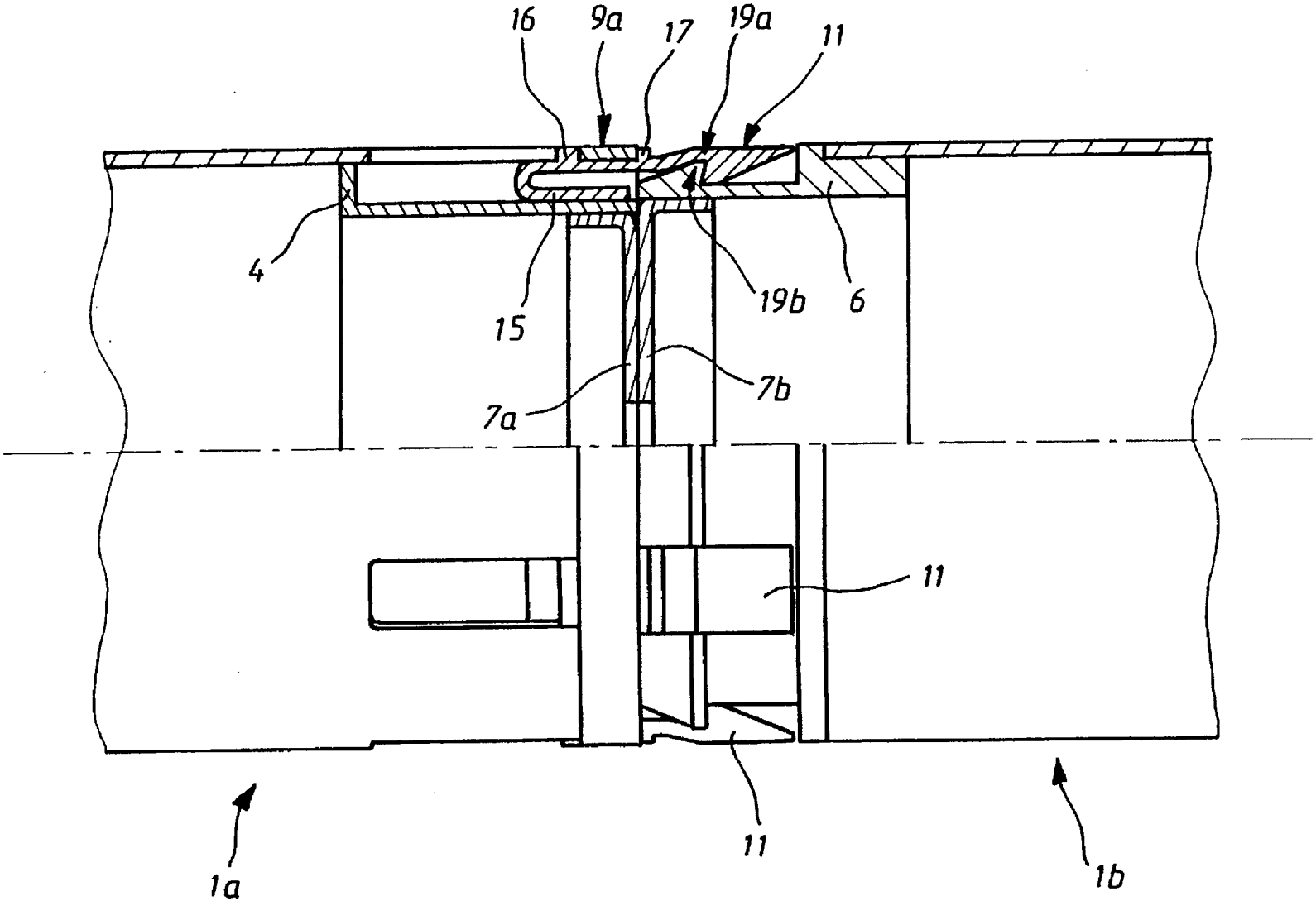
FIG. 4 shows the containers of FIG. 1 joined by a device according to the invention.

FIG. 4 shows the two containers 1*a* and 1*b* joined by the linking device according to the first embodiment.

The containers have been assembled by joining the first face 2*a* of the first container 1*a* to the second face 2*b* of the second container 1*b*. The alignment of the containers may be carried out using matching concave and convex surfaces made on the plugs 7*a*, 7*b*, as is described in French Patent FR2711209 (not shown).

The hooks 11 are moved axially such that the two matching profiles 19*a*, 19*b* of the hooks and of the groove 18 cooperate with each other. The axial movement of each hook may be carried out by pushing manually on the flexible fold and by sliding the hook towards the second face 2*b*.

The axial and radial locking of each hook is ensured by the peg 16 and the heel 17 that grip the collar 9*a* of the lid 4 to form stops under the action of the flexible fold 15. The hooks ensure that the two containers are joined in a rigid and reliable manner.

The tip 20 has a tapered angle 23 approximately equal to that of a tapered support 24 on the base 6 to facilitate sliding the hook 11 into the groove 18.

The end plugs 7*a* and 7*b* may be formed as a single piece with the lid 4 and the base 6, respectively.

The lid and the base 6 may also be formed as a single piece with the container attached to the projectile and the container attached to the base, respectively.

The hooks 11 have an outer profile approximately equal to the outer diameter of the containers 1*l*, 1*b*. Thus, when the hooks 11 are in their locking position (FIG. 4) they are held in this position by the inner surface of the weapon chamber (not shown). Such an arrangement increases the rigidity of the link and ensures that the two joined containers can be withdrawn from the chamber.

To disassemble the joined containers, each hook 11 is disengaged from its groove 18 by pulling it by hand. The flexibility of the hook material facilitates its disengagement.

Figure 5:
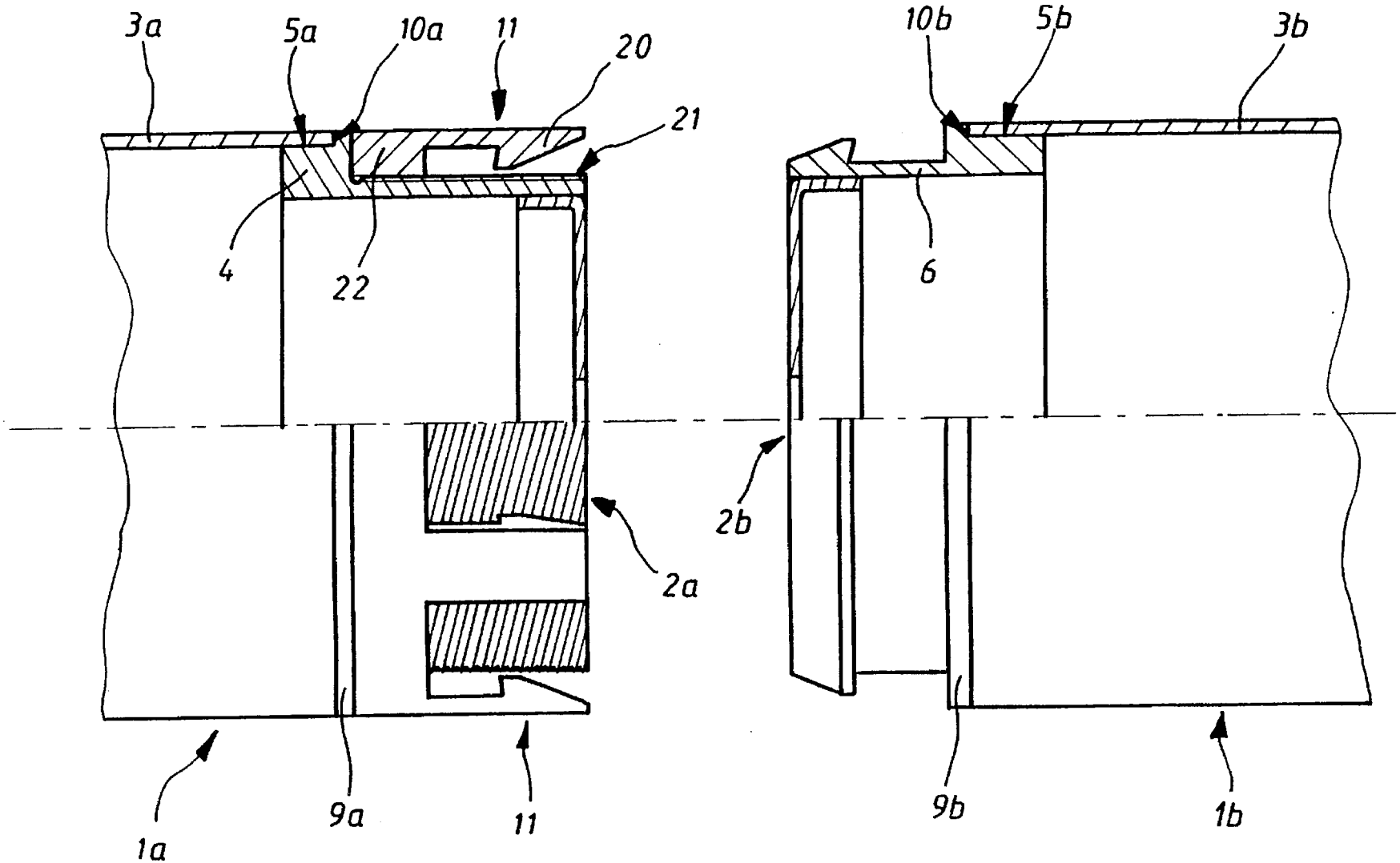
FIG. 5 shows a partial section of two containers before assembly according to a second embodiment of the invention.

FIG. 5 shows two containers according to a second embodiment of the invention before being joined to each other.

The container 1*b* has a base 6 identical to that shown in FIG. 1.

The container 1*a* includes a lid 4 formed as one piece of a plastic material with the outer surface 3*a*, for example, by bonding the lid 4 to the outer surface 3*a* adjacent the cylindrical support 52. The lid 4 includes a collar 9*a* against which the end 10*a* of the outer surface 3*a* is abutted.

The lid 4 has a threaded cylindrical part 21 upon which a tapped ring 22 is engaged.

The ring 22 includes hooks 11 in which the tip 20 of each hook 11 is identical to that of the hooks described above in connection with FIGS. 1 to 4. The hooks, of which there are six in this example, are designed to join the two containers together by cooperation between the profile 19*a* of the hook and the matching profile 19*b* of the base 6.

Figure 6:
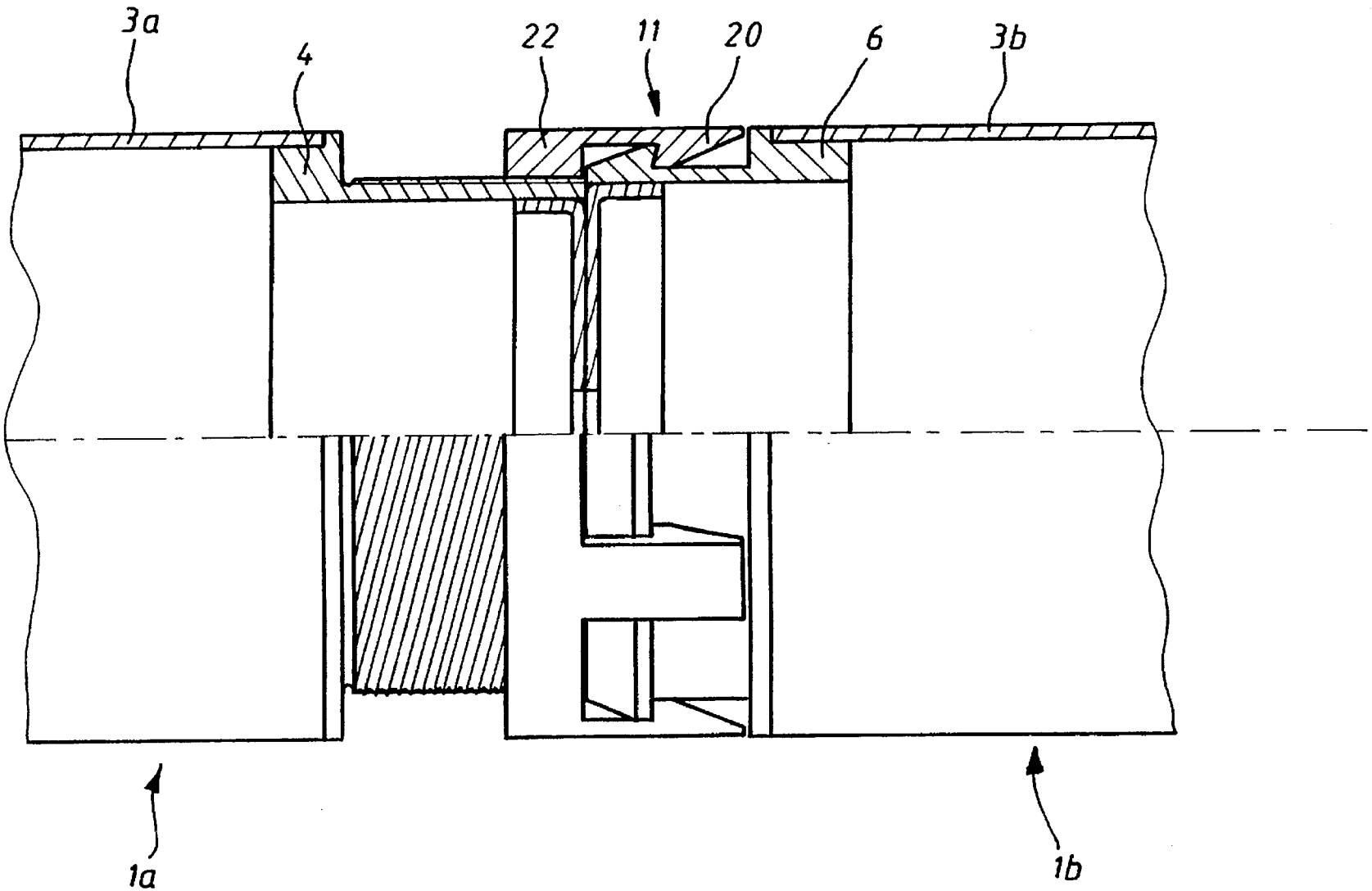
FIG. 6 shows the containers of FIG. 5 joined by a device according to the invention.

FIG. 6 shows the two containers 1*a* and 1*b* of FIG. 5 joined by the linking device according to the second embodiment of the invention.

The axial movement of the hooks 11 is ensured in this embodiment by the threaded ring 22 which, by being screwed and unscrewed, may rotate with respect to the lid 4. The hooks 11 may then be positioned in the circular groove 18 by engaging the tip 20 of each hook, as shown in FIG. 6.

An axial stop may be disposed adjacent the first face 2*a* of the container 1*a* to prevent the ring 22 from becoming disengaged from the threaded cylindrical part 22 (not shown).

The second embodiment permits two containers to be joined in a single operation because the ring 22 positions all the hooks at once in the circular groove 18 and enables the assembly to be tightened after the tips are positioned, thereby increasing the rigidity of the link.

Figure 7:
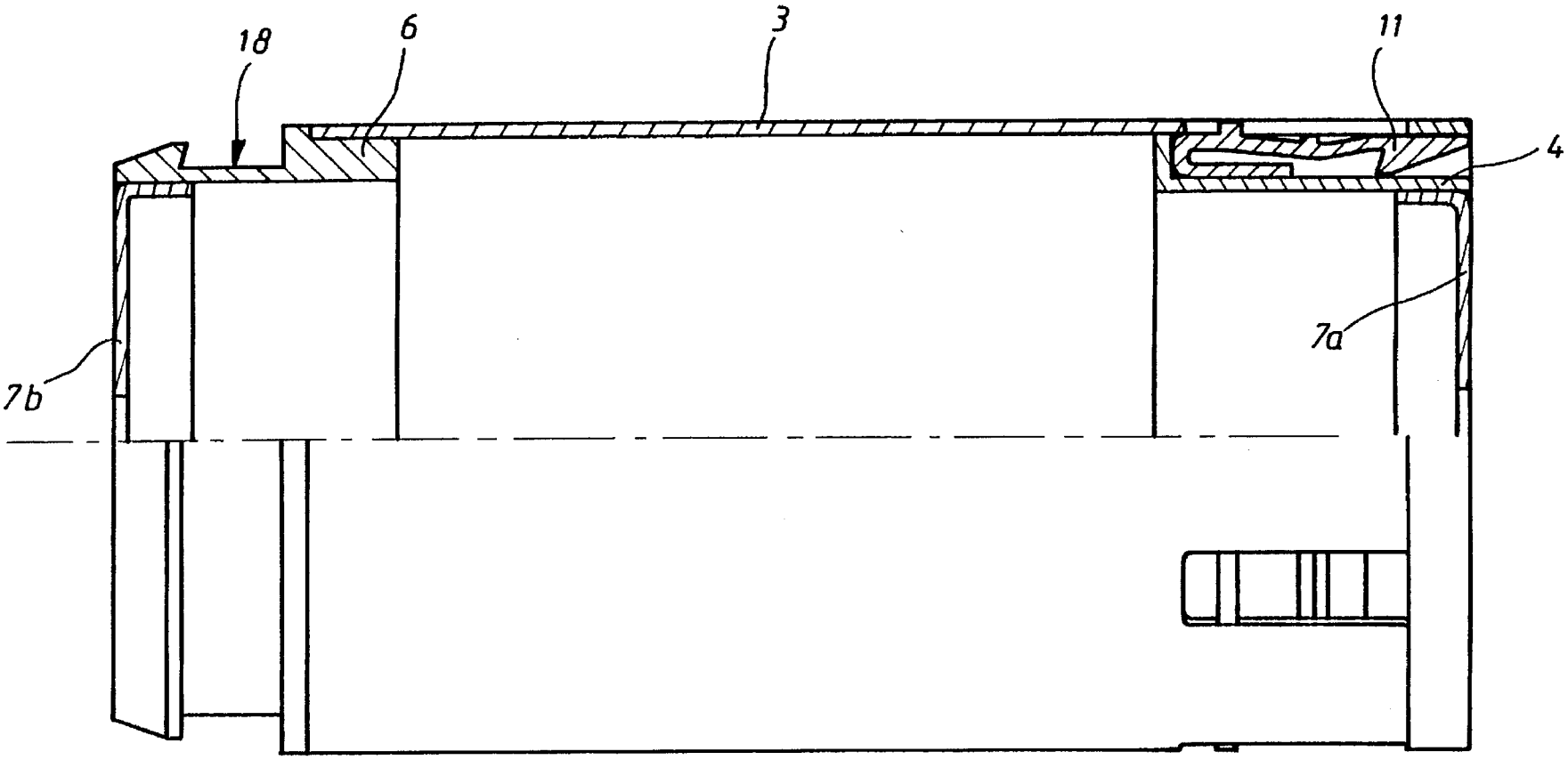
FIG. 7 shows a modular-type container according to the invention.

FIG. 7 shows a modular-type container according to the invention. This container, which is made of a combustible material similar to that described above, is designed to be joined to other substantially identical containers.

The container includes a combustible outer surface 3 that is closed off by two end plugs 7*a* and 7*b*.

One end of the container includes a base 6 having a groove 18, the other end includes a lid 4 fitted with hooks 11.

If the container does not need to be linked to another container, the hooks are left in their storage position in which they remain secure because the flexible fold 15 urges each hook against its housing.

If it is necessary for two containers to be joined to each other, the hooks are moved axially until their tips engage the groove 18 of another container.

Alternatively, the modular container can include the lid 4 that is fitted with a linking device according to the second embodiment of the invention as described above and shown in FIGS. 5 and 6.

We claim:

1. A device for joining a first face of a first container to a second face of a second container, said first face and said second face being alignable along a longitudinal axis, said device comprising:

a plurality of hooks spaced around a periphery of said first face of said first container, said hooks having tips and being movable in a direction parallel to said longitudinal axis, each of said hooks includes a peg that projects through a slot in said first container, said slot being substantially parallel to said longitudinal axis and terminating at one end at a collar disposed adjacent said first face; and a hook receiving portion disposed around a periphery of said second face of said second container, said hook receiving portion including a groove shaped to receive said tips of said hooks such that said first container can be joined to said second container.

2. The device of claim 1, wherein said groove includes a slanted surface that extends away from said first container and forms an angle of less than 90° with said longitudinal axis.

3. The device of claim 1, wherein said groove includes a slanted surface that extends away from said first container and forms an angle of approximately 80° with said longitudinal axis.

4. The device of claim 1, further comprising housings attached to said periphery of said first face and disposed to at least partially cover said hooks, said housings being shaped to guide said hooks to move parallel to said longitudinal axis.

5. The device of claim 1, wherein each of said hooks includes a heel that engages said periphery of said first face when said peg abuts said collar to secure said hook within said slot.

6. The device of claim 5, wherein each of said hooks includes a heel urged by said flexible folded portion to engage said periphery of said first face when said peg abuts said collar to secure said hook within said slot.

7. The device of claim 1, wherein each of said hooks includes a flexible folded portion that urges said hooks to maintain contact with said first container.

8. The device of claim 1, wherein said hooks are fabricated of one of polyoxymethylene, high density polyethylene and polyamide.

9. A container joinable to other containers, said container having an outer surface, a first face and a second face aligned along a longitudinal axis, and a device for joining said container to said other containers, said device comprising:

a plurality of hooks spaced around a periphery of at least said first face, said hooks having tips and being movable in a direction substantially parallel to said longitudinal axis to engage a second face of a first of said other containers, each of said hooks includes a peg that projects through a slot in said outer surface of said container, said slot being substantially parallel to said longitudinal axis and terminating at one end at a collar disposed adjacent said first face; and a hook receiving portion disposed around a periphery of at least said second face of said first other container, said hook receiving portion including a groove shaped to receive said tips of said hooks to engage a said second face of said first other container.

10. The container of claim 9, wherein said groove includes a slanted surface that extends away from said container and forms an angle of less than 90° with said longitudinal axis.

11. The container of claim 9, further comprising housings attached to said periphery of said first face and disposed to at least partially cover said hooks, said housings being shaped to guide said hooks to move substantially parallel to said longitudinal axis.

12. The container of claim 9, wherein each of said hooks includes a heel that engages said periphery of said first face when said peg abuts said collar to secure said hook within said slot.

13. The container of claim 9, wherein each of said hooks includes a flexible folded portion that urges said hooks to maintain contact with said container.

14. The container of claim 9, wherein said groove is formed in said outer surface of said container.

15. The container of claim 9, wherein said first face includes a lid, said lid having a relieved peripheral collar with spaced openings through which said hooks are extendible.

16. The container of claim 15, wherein housings are formed in said outer surface and in said lid, said housings being disposed to at least partially to cover said hooks and shaped to guide said hooks to move parallel to said longitudinal axis.

17. A device for joining a first face of a first container to a second face of a second container, said first face and said second face being alignable along a longitudinal axis, said device comprising:

a plurality of hooks spaced around a periphery of said first face of said first container, said hooks having tips and being movable in a direction parallel to said longitudinal axis, said first face includes a ring and said hooks are connected to said ring, said ring being threadedly connected to said first container such that rotating said ring moves said hooks in translation substantially parallel to said longitudinal axis; and a hook receiving portion disposed around a periphery of said second face of said second container, said hook receiving portion including a groove shaped to receive said tips of said hooks such that said first container can be joined to said second container.

18. The device of claim 17, wherein said groove includes a slanted surface that extends away from said first container and forms an angle of less than 90° with said longitudinal axis.

19. The device of claim 17, wherein said groove includes a slanted surface that extends away from said first container and forms an angle of approximately 80° with said longitudinal axis.

20. The device of claim 17, wherein said hooks are fabricated of one of polyoxymethylene, high density polyethylene and polyamide.

21. A container joinable to other containers, said container having an outer surface, a first face and a second face aligned along a longitudinal axis, and a device for joining said container to said other containers, said device comprising:

a plurality of hooks spaced around a periphery of at least said first face, said hooks having tips and being movable in a direction substantially parallel to said longitudinal axis to engage a second face of a first of said other containers, said first face includes a ring and said hooks are connected to said ring, said ring being threadedly connected to said container such that rotating said ring moves said hooks substantially parallel to said longitudinal axis; and a hook receiving portion disposed around a periphery of at least said second face of said first other container, said hook receiving portion including a groove shaped to receive said tips of said hooks to engage a said second face of said first other container.

22. The container of claim 21, wherein said groove includes a slanted surface that extends away from said container and forms an angle of less than 90° with said longitudinal axis.

23. The container of claim 21, wherein said groove is formed in said outer surface of said container.

* * * * *